US011022337B2

(12) United States Patent
Heigl

(10) Patent No.: US 11,022,337 B2
(45) Date of Patent: Jun. 1, 2021

(54) AIR CONDITIONING SYSTEM

(71) Applicant: Carrier Corporation, Palm Beach Gardens, FL (US)

(72) Inventor: Keith David Heigl, Winamac, IN (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 81 days.

(21) Appl. No.: 16/196,714

(22) Filed: Nov. 20, 2018

(65) Prior Publication Data

US 2019/0154293 A1 May 23, 2019

Related U.S. Application Data

(60) Provisional application No. 62/588,587, filed on Nov. 20, 2017.

(51) Int. Cl.

| | |
|---|---|
| ***F24F 11/89*** | (2018.01) |
| ***F24F 11/30*** | (2018.01) |
| ***F24F 11/88*** | (2018.01) |
| ***F24F 11/80*** | (2018.01) |
| ***F24F 120/12*** | (2018.01) |
| ***F24F 110/10*** | (2018.01) |

(52) U.S. Cl.

CPC ..... *F24F 11/89* (2018.01); *F24F 11/30* (2018.01); *F24F 11/80* (2018.01); *F24F 11/88* (2018.01); *F24F 2110/10* (2018.01); *F24F 2120/12* (2018.01)

(58) Field of Classification Search

CPC .. F24F 11/89; F24F 11/30; F24F 11/88; F24F 11/80; F24F 2120/12; F24F 2110/10

See application file for complete search history.

(56) References Cited

U.S. PATENT DOCUMENTS

| | | | | |
|---|---|---|---|---|
| 4,407,447 | A | 10/1983 | Sayegh | |
| 5,819,840 | A * | 10/1998 | Wilson | G05D 23/1902 165/11.1 |
| 7,058,477 | B1 | 6/2006 | Rosen | |
| 2006/0071089 | A1 | 4/2006 | Kates | |
| 2007/0045429 | A1 | 3/2007 | Chapman, Jr. et al. | |
| 2007/0045431 | A1 | 3/2007 | Chapman, Jr. et al. | |

(Continued)

FOREIGN PATENT DOCUMENTS

| | | | |
|---|---|---|---|
| CN | 104823121 | A | 8/2015 |
| WO | 2016148651 | A1 | 9/2016 |
| WO | 2017114582 | A1 | 7/2017 |

*Primary Examiner* — Kun Kai Ma

(74) *Attorney, Agent, or Firm* — Cantor Colburn LLP

(57) ABSTRACT

An air conditioning system for an occupiable structure having a plurality of regions includes a plurality of air condition sensors, an air conditioning unit, and a programmable controller. The air condition sensor assemblies are each located in a respective region of the plurality of regions. The air conditioning unit is adapted to condition air in the occupiable structure. The controller is configured to receive a plurality of condition signals from each one of the plurality of air condition sensor assemblies and output an activate command that facilitates activating the air conditioning unit. The activate command is based on any one of the condition signals and a preprogrammed condition threshold. Each one of the condition signals is associated with a respective programmed time interval of a plurality of programmed time intervals.

17 Claims, 2 Drawing Sheets

(56) References Cited

U.S. PATENT DOCUMENTS

| | | | | |
|---|---|---|---|---|
| 2008/0133061 | A1 | 6/2008 | Hoglund et al. | |
| 2008/0223943 | A1 | 9/2008 | Mulhouse et al. | |
| 2010/0006660 | A1* | 1/2010 | Leen | G05D 23/1931 236/51 |
| 2010/0243231 | A1 | 9/2010 | Rosen | |
| 2011/0031322 | A1* | 2/2011 | Zou | F24F 3/0442 236/1 B |
| 2011/0054699 | A1 | 3/2011 | Imes et al. | |
| 2011/0077780 | A1 | 3/2011 | Hoglund et al. | |
| 2011/0253796 | A1* | 10/2011 | Posa | F24F 11/30 236/49.3 |
| 2012/0067560 | A1* | 3/2012 | Bergman | F24F 11/30 165/238 |
| 2012/0067561 | A1* | 3/2012 | Bergman | B60H 1/00657 165/257 |
| 2012/0128025 | A1 | 5/2012 | Huppi et al. | |
| 2012/0261481 | A1 | 10/2012 | Donlan | |
| 2012/0318490 | A1 | 12/2012 | Kopp | |
| 2013/0211600 | A1* | 8/2013 | Dean-Hendricks | F24F 11/30 700/278 |
| 2013/0261807 | A1 | 10/2013 | Zywicki et al. | |
| 2015/0167989 | A1* | 6/2015 | Matsuoka | G05D 23/1923 700/276 |
| 2017/0003668 | A1* | 1/2017 | Burt | G05B 19/042 |
| 2018/0115788 | A1* | 4/2018 | Burns | G06K 9/00771 |
| 2019/0033901 | A1* | 1/2019 | Mantese | G05D 23/1932 |
| 2020/0116369 | A1* | 4/2020 | Schultz | F24F 11/523 |

* cited by examiner

AIR CONDITIONING SYSTEM

CROSS-REFERENCE TO RELATED APPLICATIONS

This application claims the benefit of U.S. Provisional Application No. 62/588,587 filed Nov. 20, 2017, which is incorporated herein by reference in its entirety.

BACKGROUND

The present disclosure relates to an air conditioning system, and more particularly, to a control system of the air conditioning system.

Air conditioning systems used, for example, to heat and/or cool a plurality of rooms within a dwelling typically operate off of a singular, wall-mounted, thermostat. Such thermostats are typically located in a central location within the dwelling. When the air temperature proximate to the thermostat falls sufficiently outside of a preprogrammed setpoint, the thermostat is configured to output a command to an air conditioning unit of the system to re-establish the desired air temperature proximate to the thermostat. Ideally, remote regions and/or rooms from the thermostat receive sufficient air conditioning to come close to the temperature setup. Unfortunately, depending on a wide range of factors, air temperatures between rooms, and remote from the thermostat shall deviate to a point where the occupant may experience discomfort, and/or additional energy is consumed to alleviate any discomfort and/or excessive air condition disparities between rooms and/or regions.

BRIEF DESCRIPTION

An air conditioning system according to one, non-limiting, embodiment of the present disclosure is applied to an occupiable structure having a plurality of regions. The air conditioning system includes a plurality of air condition sensor assemblies each located in a respective region of the plurality of regions; an air conditioning unit constructed and arranged to condition air in the occupiable structure; and a programmable controller configured to receive a plurality of condition signals from each one of the plurality of air condition sensor assemblies and output an activate command that facilitates activating the air conditioning unit, wherein the activate command is based on any one of the plurality of condition signals and a preprogrammed condition threshold, and wherein each one of the plurality of condition signals is associated with a respective programmed time interval of a plurality of programmed time intervals.

Additionally to the foregoing embodiment, each one of the plurality of air condition sensor assemblies include a temperature sensor.

In the alternative or additionally thereto, in the foregoing embodiment, the air conditioning unit includes a furnace.

In the alternative or additionally thereto, in the foregoing embodiment, the air conditioning unit includes a hydronic heating system.

In the alternative or additionally thereto, in the foregoing embodiment, the air conditioning unit includes an air cooling system.

In the alternative or additionally thereto, in the foregoing embodiment, the programmable controller is a thermostat remotely located from the air conditioning unit, the thermostat including a processor, an electronic storage medium, and a temperature sensor configured to measure air temperature in the occupiable structure and output a temperature signal indicative of the measured air temperature to the processor, wherein the processor compares the temperature signal to the condition threshold and outputs a thermostat activate command to the air conditioning unit that facilitates activation when the measured air temperature does not occur during any one of the plurality of programmed time intervals.

In the alternative or additionally thereto, in the foregoing embodiment, the air conditioning unit includes a unit controller configured to receive the thermostat activate command.

In the alternative or additionally thereto, in the foregoing embodiment, the preprogrammed condition threshold is applied to all of the plurality of condition signals.

In the alternative or additionally thereto, in the foregoing embodiment, the air conditioning system includes at least one occupant sensor configured to send an occupant signal to the processor of the thermostat indicative of the occupiable structure being occupied, wherein the thermostat is configured to control the air condition unit via the temperature sensor of the thermostat when the occupiable structure is not occupied.

In the alternative or additionally thereto, in the foregoing embodiment, the thermostat is configured to control the air condition unit via one of the plurality of condition sensor assemblies when the occupant structure is occupied and an associated condition signal of the plurality of condition signals occurs during one of the plurality of programmed time intervals.

In the alternative or additionally thereto, in the foregoing embodiment, the air conditioning system is a single zone system.

In the alternative or additionally thereto, in the foregoing embodiment, the air condition system includes a thermostat remotely located from the air conditioning unit, the thermostat including a processor, an electronic storage medium, and a temperature sensor configured to measure air temperature in the occupiable structure and output a temperature signal indicative of the measured air temperature to the processor, wherein the programmable controller is part of and local to the air conditioning unit and is configured to receive an activate command from the thermostat and thereby activates an air treatment device of the air conditioning unit based on the activate command if the measured air temperature does not occur during any one of the plurality of programmed time intervals.

A control system according to another, non-limiting, embodiment is used for an air conditioning unit adapted to condition air in an occupiable structure having a plurality of regions. The control system includes a plurality of regional air temperature sensor assemblies each located in a respective region of the plurality of regions, and configured to respectively output a plurality of regional temperature signals; and a thermostat configured to be preprogrammed with a temperature threshold and a plurality of time intervals with each time interval associated with a respective one of the plurality of regions, wherein the programmable thermostat is configured to receive the plurality of regional temperature signals and output an activate command to the air conditioning unit based on the temperature threshold and a selected one of a temperature signal outputted from a temperature sensor of the programmable thermostat, and a regional temperature signal of the plurality of regional temperature signals.

Additionally to the foregoing embodiment, the thermostat is configured to associate a current time to a time interval of the plurality of time intervals and compare a regional temperature signal of the plurality of regional temperature signals associated with the associated time interval to the temperature threshold to determine outputting the activate command.

In the alternative or additionally thereto, in the foregoing embodiment, the thermostat is configured to utilize the temperature signal to determine outputting the activate command when the current time does not fall within one of the plurality of time intervals.

In the alternative or additionally thereto, in the foregoing embodiment, the plurality of regional temperature signals are sent wirelessly.

In the alternative or additionally thereto, in the foregoing embodiment, the control system includes an occupancy sensor configured to output an occupancy signal, wherein the thermostat is configured to process the occupancy signal and utilize the temperature signal and not the plurality of regional temperature signals to determine outputting the activate command when the thermostat determines that the occupiable structure is not occupied.

In the alternative or additionally thereto, in the foregoing embodiment, the occupancy sensor is part of the thermostat.

The foregoing features and elements may be combined in various combinations without exclusivity, unless expressly indicated otherwise. These features and elements as well as the operation thereof will become more apparent in light of the following description and the accompanying drawings. However, it should be understood that the following description and drawings are intended to be exemplary in nature and non-limiting.

BRIEF DESCRIPTION OF THE DRAWINGS

Various features will become apparent to those skilled in the art from the following detailed description of the disclosed non-limiting embodiments. The drawings that accompany the detailed description can be briefly described as follows.

DETAILED DESCRIPTION

Figure 1:
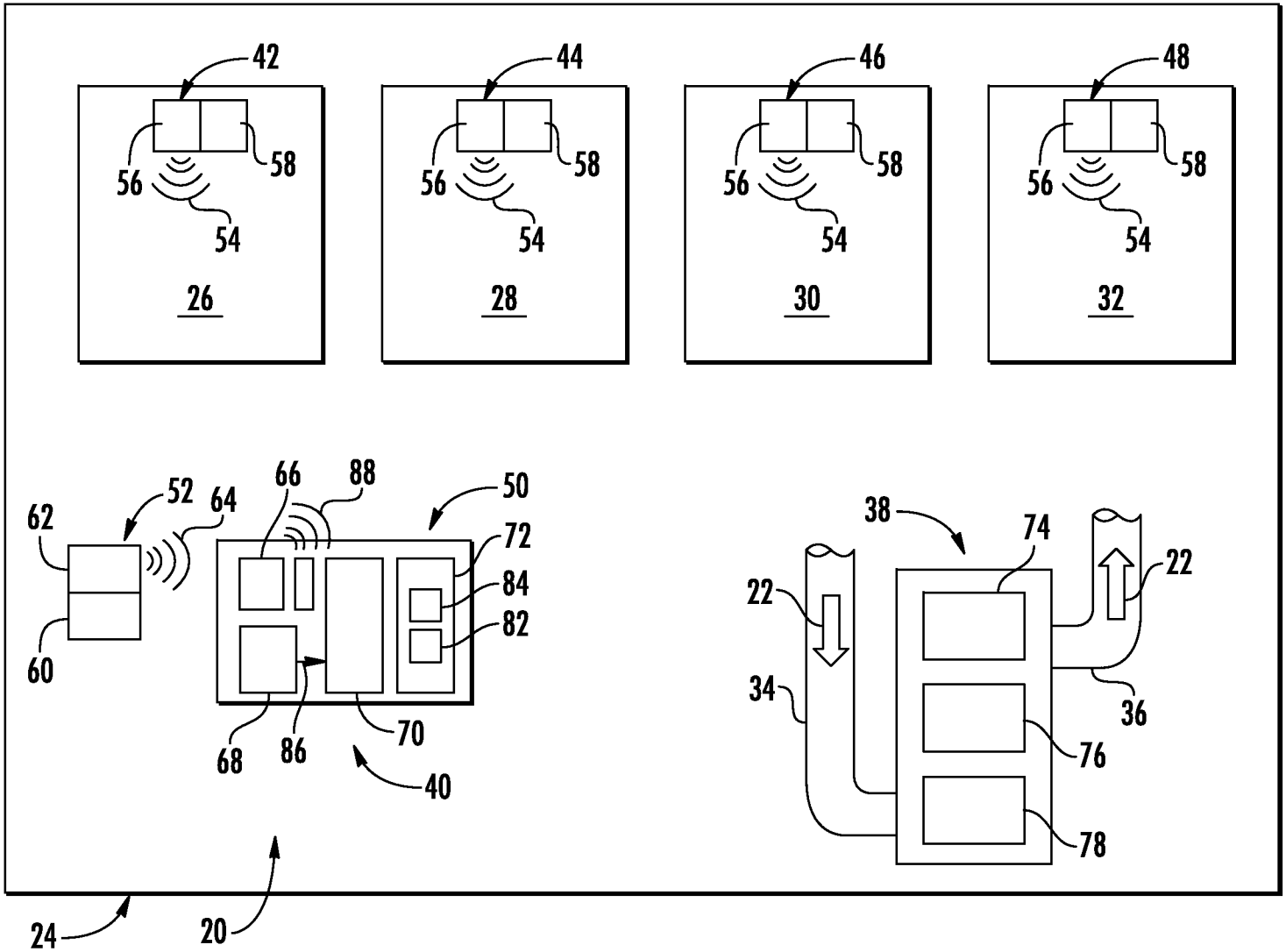
FIG. 1 is a schematic of an occupiable structure utilizing an air condition system of the present disclosure, and in accordance with one, non-limiting, exemplary embodiment.

Referring to FIG. 1, an air conditioning system 20 may be located, and constructed to condition air (see arrows 22), in an occupiable structure 24 (e.g., dwelling, home, and others) having a plurality of regions or rooms (i.e., four examples illustrated as living room 26, bedroom 28, kitchen 30, family room 32). The conditioning of the air 22 may be a process that heats, cools, and/or controls humidity levels of the air 22. In one embodiment, the air conditioning system 20 may be a forced air conditioning system that includes air return and air supply ducts, or plenums, 34, 36 generally routed to each room 26, 28, 30, 32. In another embodiment, the air conditioning system 20 may be a hydronic system that may include heat registers in each room 26, 28, 30, 32 for heating of the air therein. Yet further, the air conditioning system 20 may be a simplified single zone system, thus may not include automated valves or dampers typically used to direct, for example, heated water or air to specific rooms.

The air conditioning system 20 may include an air condition unit 38 and a control system 40 configured to activate the air condition unit 38 in a manner based on occupancy and a series of time intervals each associated with a respective region 26, 28, 30, 32. The control system 40 may include a plurality of condition sensor assemblies (i.e., four illustrated as 42, 44, 46, 48), a central controller 50 (e.g., thermostat), and an occupant sensor assembly 52. Each condition sensor assembly 42, 44, 46, 48 may be located in a respective region 26, 28, 30, 32 of the occupiable structure 24. The sensor assemblies 42, 44, 46, 48 are configured to measure the condition of the air in the respective regions 26, 28, 30, 32 and output a condition signal 54 indicative of the measured air condition. The remote controller 50 may be configured to receive and process the condition signal 54.

In one embodiment, the control system 40 may generally be a wireless system. As a wireless system, each condition sensor assembly 42, 44, 46, 48 may include an air condition sensor 56 and a transmitter, or transceiver, 58. Similarly, the occupant sensor assembly 52 may be wireless, and thus includes an occupancy sensor 60 and a transmitter, or transceiver, 62 for sending a wireless occupancy signal 64 to the central controller 50. It is contemplated and understood that any one, or more, of the sensor assemblies 42, 44, 46, 48, 52 may not be wireless, and instead may be hardwired to the central controller 50 and/or the air condition unit 38.

In yet another embodiment, the control system 40 may be configured to operate with any conventional and/or pre-existing air conditioning unit 38. For example and where the air condition is temperature, a pre-existing (i.e., traditional) thermostat may be replaced with the control system 40. More specifically, the novel thermostat 50 of the present disclosure may be wall mounted in a location proximate to the thermostat to be replaced. The temperature sensor assemblies 26, 28, 30, 32 may be positioned and/or mounted to walls or ceilings with respective regions 26, 28, 30, 32. The occupancy sensor assembly 52 may, for example, be place proximate to an entry point, or high traffic area, of the occupiable structure 24. Once the various components are appropriately located, the central controller 50 may be programmed in accordance with the particular structure and in accordance with the occupying habits of a particular occupant. To establish a fully operational air conditioning system 20, no changes or alterations need to be made to the air conditioning unit 38, which may be pre-existing.

The central controller 50 may include a receiver, or transceiver, 66 for receiving the wireless signals 54, 64, an air condition sensor 68, a processor 70 (e.g., microprocessor), and an electronic storage medium 72 that may be computer writeable and readable. In one embodiment, the central controller 50 may be remotely located from the air conditioning unit 38. The air conditioning unit 38 may include a controller 74 configured to generally communicate with the central controller 50 (i.e., wirelessly or hardwired), and generally control and monitor operation of the air conditioning unit 38.

In one embodiment, the air conditioning unit 38 may be a forced air conditioning unit having an air treatment device 76 and a blower 78 adapted to move air through the plenums 34, 36. In a, non-limiting, example where the air condition is temperature, the air treatment device 76 may be a heater (e.g., gas or electric heater) and the air condition sensors 56 may be temperature sensors. In another embodiment, the central controller 50 may not be remotely located from the air conditioning unit 38, and may be, or may be part of, the unit controller 74. Yet further and in another embodiment, the occupant sensor 60 may not be remotely located from the central controller 50, and instead, may be an integral part of the central controller 50 wherein the sensors 60, 68, transceiver 66, processor 70 and storage medium 72 are located within a common housing (not shown) of the central controller 50.

Figure 2:
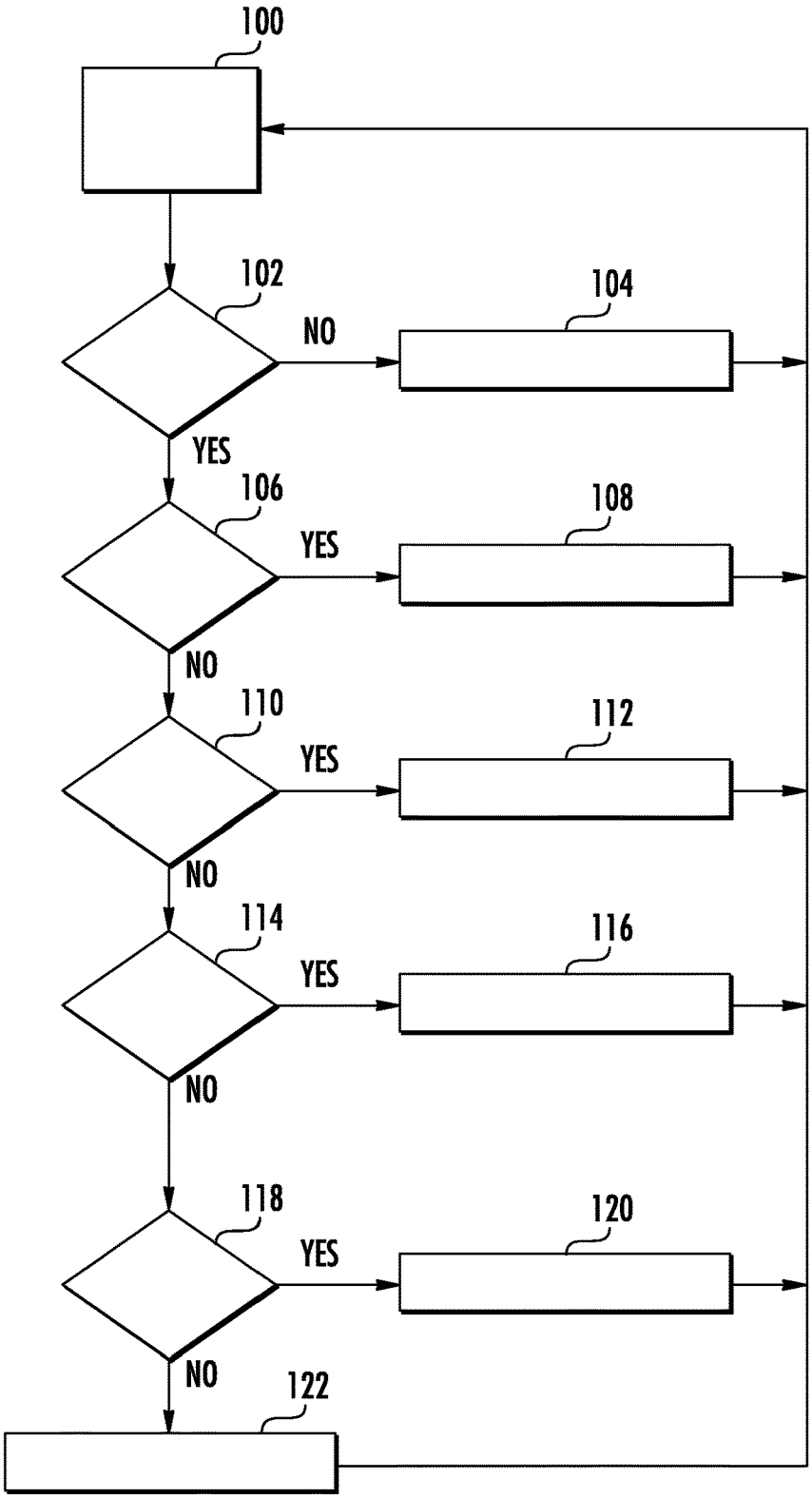
FIG. 2 is a flow chart of a method of operating the air conditioning system.

Referring to FIGS. 1 and 2, programming and/or setup, of the air conditioning system 20 may be accomplished by a user of the system and/or occupant of the occupiable structure 24. Through a user interface 80 of the central controller 50, the occupant may enter an air condition threshold 82 that is stored in the storage medium 72 of the central controller 50. In one embodiment, the air condition threshold 82 may be an air temperature threshold indicative of a temperature within an occupant comfort zone (e.g., about 72 degrees Fahrenheit). The occupant may then enter a series of time intervals 84 and associate each time interval with a respective region 26, 28, 30, 32. The specific region and associated time interval is indicative of a prediction of where the occupant will be within the time interval 84. The series of time intervals 84 may be successive and lie within a 24 hour period (i.e., one day), and generally repeat for each day thereafter.

For example, for living room 26, a time interval of "5 pm to 6 pm" may be chosen indicative of the occupant most likely being in the living room 26 at that time interval. For bedroom 28, the time interval may be "11 pm to 1 am" that is indicative of a time interval that the occupant expects to be sleeping and/or is in the bedroom 28. For kitchen 30, there may be two time intervals, such as "7 am to 8 am" and "6 pm to 7 pm" indicative of periods that the occupant typically cooks and/or consumes meals.

Once the occupant or user has associated particular time intervals 84 with respective regions 26, 28, 30, 32, and has chosen an air condition threshold 82 (i.e., all programmed and stored in the storage medium 72 of the central controller 50), the air conditioning system 20 may be operational.

FIG. 2 is a flow chart of a method of operating the air conditioning system. In operation, and at block 100, the processor 70 of the central controller 50 may generally track real time. At block 102, the central controller 50 may receive an occupancy signal 64 from the occupancy sensor assembly 52, and the processor 70 may evaluate signal 64 to determine if the occupiable structure 24 is occupied. If "no" and at block 104, the central controller 50 may not acknowledge and/or receive the regional air condition signals 54, and instead, may process the central air condition signal 86 from the air condition sensor 68 of the controller 50. If the air condition threshold 82 is met (i.e., and/or is sufficiently deviated therefrom), the processor 70 via the transceiver 66 of the central controller 50 may send an activate command 88 to the controller 38 of the air condition unit 38. Thus, the air condition unit 38 operates based on air condition measurements from the air condition sensor 68 of the central controller 50 and not the regional air condition signals 54 of the remotely located (i.e., regional) air condition sensors 56.

If the occupiable structure 24 is determine to be occupied, and at block 106, the processor 70 of the central controller 50 may determine if the real time is within a time interval 84 pre-associated with region 26. If "yes" and at block 108, and during the prescribed time interval, the central controller 50 utilizes the air condition signal 54 from the regional sensor assembly 42 to determine if an activate command 88 should be sent to the air condition unit 38 based, at least in-part, on the preprogrammed air condition threshold 82.

At block 110, with the structure 24 occupied, and if the current time does not fall within the first time interval 84, the processor 70 of the central controller 50 determines if the real time falls within a second time interval 84 that may be associated with the second region 28. If "yes" and at block 112, and during the prescribed second time interval, the central controller 50 utilizes the air condition signal 54 from the regional sensor assembly 44 to determine if an activate command 88 should be sent to the air condition unit 38 based, at least in-part, on the preprogrammed air condition threshold 82.

At block 114, with the structure 24 occupied, and if the current time does not fall within the second time interval 84, the processor 70 of the central controller 50 determines if the real time falls within a third time interval 84 that may be associated with the third region 30. If "yes" and at block 116, and during the prescribed third time interval, the central controller 50 utilizes the air condition signal 54 from the regional sensor assembly 46 to determine if an activate command 88 should be sent to the air condition unit 38 based, at least in-part, on the preprogrammed air condition threshold 82.

At block 118, with the structure 24 occupied, and if the current time does not fall within the third time interval 84, the processor 70 of the central controller 50 determines if the real time falls within a fourth time interval 84 that may be associated with the fourth region 30. If "yes" and at block 120, and during the prescribed fourth time interval, the central controller 50 utilizes the air condition signal 54 from the regional sensor assembly 48 to determine if an activate command 88 should be sent to the air condition unit 38 based, at least in-part, on the preprogrammed air condition threshold 82.

This process generally repeats itself until all prescribed time intervals 84 have been reviewed by the processor 70 of the central controller 50. At block 122 and if the current or real time does not fall within a prescribed time interval 84, the processor 70 of the central controller 50 may utilize the air condition signal 86 from the central air condition sensor 68 to determine if an activate command 88 should be sent to the air condition unit 38 based, at least in-part, on the preprogrammed air condition threshold 82.

Advantages and benefits of the present disclosure include a system configured to control the temperature within a dwelling based on temperature measurement taken in an occupied room within the dwelling. Other benefits may include a savings in energy consumption since the system focuses on temperature within occupied rooms instead of unoccupied rooms or regions.

While the present disclosure is described with reference to illustrated embodiments, it will be understood by those skilled in the art that various changes may be made and equivalents may be substituted without departing from the spirit and scope of the present disclosure. In addition, various modifications may be applied to adapt the teachings of the present disclosure to particular situations, applications, and/or materials, without departing from the essential scope thereof. The present disclosure is thus not limited to the particular examples disclosed herein, but includes all embodiments falling within the scope of the appended claims.

What is claimed is:

1. An air conditioning system for an occupiable structure having a plurality of regions, the air conditioning system comprising:

a plurality of air condition sensor assemblies each located in a respective region of the plurality of regions;

an air conditioning unit constructed and arranged to condition air in the occupiable structure; and a programmable controller configured to receive a plurality of condition signals from each one of the plurality of air condition sensor assemblies and output an activate command that facilitates activating the air conditioning unit, wherein the activate command is based on any one of the plurality of condition signals and a preprogrammed condition threshold, and wherein each one of the plurality of condition signals is associated with a respective programmed time interval of a plurality of programmed time intervals, and the plurality of programmed time intervals are successive and do not overlap one-another.

2. The air conditioning system set forth in claim 1, wherein each one of the plurality of air condition sensor assemblies include a temperature sensor.

3. The air conditioning system set forth in claim 1, wherein the air conditioning unit includes a furnace.

4. The air conditioning system set forth in claim 1, wherein the air conditioning unit includes a hydronic heating system.

5. The air conditioning system set forth in claim 1, wherein the air conditioning unit includes an air cooling system.

6. The air conditioning system set forth in claim 2, wherein the programmable controller is a thermostat remotely located from the air conditioning unit, the thermostat including a processor, an electronic storage medium, and a temperature sensor configured to measure air temperature in the occupiable structure and output a temperature signal indicative of the measured air temperature to the processor, wherein the processor compares the temperature signal to the condition threshold and outputs a thermostat activate command to the air conditioning unit that facilitates activation when the measured air temperature does not occur during any one of the plurality of programmed time intervals.

7. The air conditioning system set forth in claim 6, wherein the air conditioning unit includes a unit controller configured to receive the thermostat activate command.

8. The air conditioning system set forth in claim 1, wherein the preprogrammed condition threshold is applied to all of the plurality of condition signals.

9. The air conditioning system set forth in claim 6, further comprising:

at least one occupant sensor configured to send an occupant signal to the processor of the thermostat indicative of the occupiable structure being occupied, wherein the thermostat is configured to control the air condition unit via the temperature sensor of the thermostat when the occupiable structure is not occupied.

10. The air conditioning system set forth in claim 9, wherein the thermostat is configured to control the air condition unit via one of the plurality of condition sensor assemblies when the occupant structure is occupied and an associated condition signal of the plurality of condition signals occurs during one of the plurality of programmed time intervals.

11. The air conditioning system set forth in claim 1, wherein the air conditioning system is a single zone system.

12. The air conditioning system set forth in claim 1, further comprising:

a thermostat remotely located from the air conditioning unit, the thermostat including a processor, an electronic storage medium, and a temperature sensor configured to measure air temperature in the occupiable structure and output a temperature signal indicative of the measured air temperature to the processor, wherein the programmable controller is part of and local to the air conditioning unit and is configured to receive an activate command from the thermostat and thereby activates an air treatment device of the air conditioning unit based on the activate command if the measured air temperature does not occur during any one of the plurality of programmed time intervals.

13. A control system for an air conditioning unit adapted to condition air in an occupiable structure having a plurality of regions, the control system comprising:

a plurality of regional air temperature sensor assemblies each located in a respective region of the plurality of regions, and configured to respectively output a plurality of regional temperature signals; and a thermostat configured to be preprogrammed with a temperature threshold and a plurality of time intervals with each time interval associated with a respective one of the plurality of regions, wherein the programmable thermostat is configured to receive the plurality of regional temperature signals and output an activate command to the air conditioning unit based on the temperature threshold and a selected one of a temperature signal outputted from a temperature sensor of the programmable thermostat, and a regional temperature signal of the plurality of regional temperature signals, wherein the thermostat is configured to consistently associate a current time to a time interval of the plurality of time intervals and compare a regional temperature signal of the plurality of regional temperature signals associated with the associated time interval to the temperature threshold to determine outputting the activate command.

14. The control system set forth in claim 13, wherein the thermostat is configured to utilize the temperature signal to determine outputting the activate command when the current time does not fall within one of the plurality of time intervals.

15. The control system set forth in claim 14, wherein the plurality of regional temperature signals are sent wirelessly.

16. The control system set forth in claim 14, further comprising:

an occupancy sensor configured to output an occupancy signal, wherein the thermostat is configured to process the occupancy signal and utilize the temperature signal and not the plurality of regional temperature signals to determine outputting the activate command when the thermostat determines that the occupiable structure is not occupied.

17. The control system set forth in claim 16, wherein the occupancy sensor is part of the thermostat.

* * * * *